United States Patent [19]

Nakano

[11] 4,365,732

[45] Dec. 28, 1982

[54] METHOD AND APPARATUS FOR SETTING MARKINGS IN A FABRIC

[75] Inventor: Yasuo Nakano, Yasudashi, Japan

[73] Assignee: Kabushiki Kaisha Bon'ni, Hyogoken, Japan

[21] Appl. No.: 188,750

[22] Filed: Sep. 19, 1980

[30] Foreign Application Priority Data

Sep. 25, 1979 [JP] Japan ..... 54-123622

[51] Int. Cl.[3] ..... A47F 7/00; D06F 71/34

[52] U.S. Cl. ..... 223/57; 38/144

[58] Field of Search ..... 38/15, 64, 66, 99, 144; 223/28, 30, 31, 32, 33, 34, 57; 425/363, 383; 2/243 R, 243 A

[56] References Cited

U.S. PATENT DOCUMENTS

| | | | |
|---|---|---|---|
| 2,131,545 | 9/1938 | Weisbaum | 223/57 |
| 2,171,356 | 8/1939 | Florea | 223/57 |
| 2,817,468 | 12/1957 | Brown | 38/144 X |

FOREIGN PATENT DOCUMENTS

| | | | |
|---|---|---|---|
| 112526 | 3/1966 | Netherlands | 223/28 |

*Primary Examiner*—Louis Rimrodt

*Attorney, Agent, or Firm*—Eyre, Mann, Lucas & Just

[57] ABSTRACT

A system for setting markings in a fabric, in which a material is pressed at a heat steam and hot air atmosphere under upward and downward loads, the loads being applied thereto by means of protruded pressing means of heat conducing material.

3 Claims, 12 Drawing Figures

*FIG.* 11
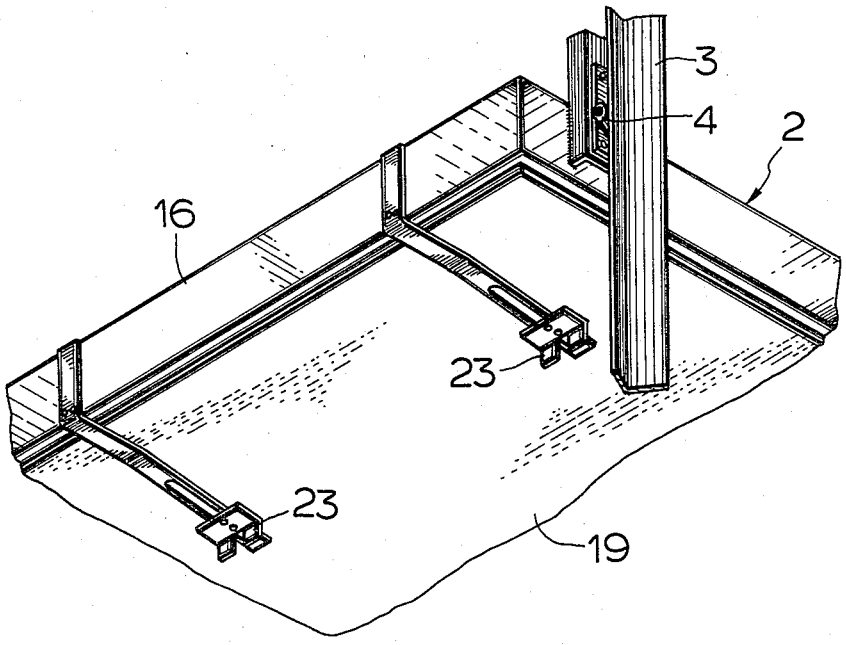

METHOD AND APPARATUS FOR SETTING MARKINGS IN A FABRIC

BACKGROUND OF THE INVENTION

1. Field of the Invention

The present invention relates generally to a system for setting markings on a fabric, such as a skirt, on an apparel manufacturing process. More particularly, the present invention relates to method and apparatus for setting markings on a fabric under steam heat pressure, which markings are used to make pleats and darts in an apparel. The markings are automatically set without the use of a hand-operated marker, such as chalk and pencil, and a pattern paper, and therefore the system of the present invention is adapted for use in an automatic mass-producing line.

2. Description of the Prior Art

In an apparel manufacturing markings become unavoidably necessary. It is the common practise to draw lines, dots or any other forms of markings with the use of chalk, a pencil or other hand-operated markers, wherein the markings are drawn with the help of a pattern paper. However, this practise is not applicable to a mass-producing process because of its labor-and time-consuming operation. For example, in a skirt manufacturing, pleating is important, but it is notoriously a time-consuming work. This is a main reason for the high price of pleated skirts.

The present invention aims at overcoming the difficulties and disadvantages pointed out with respect to the conventional practice, and has for its object to provide an improved method and apparatus for setting markings at desired places on a fabric without the use of any pattern paper or a hand-operated marker, such as chalk or a pencil.

Other objects and advantages of the present invention will become apparent from the following description and the accompanying drawings.

SUMMARY OF THE INVENTION

According to the present invention, a system for setting markings on a fabric includes a working table which allows heat steam to pass therethrough, and a pressing means which is moved up and down, the working table and the pressing means each including protruded portions adapted to come into direct contact with a material placed on the working table, the protruded portions being made of heat conducing material so as to become heated at a heated atmosphere.

BRIEF DESCRIPTION OF THE DRAWINGS

FIG. 11 is a perspective bottom view of a further modified version of the pressing frame.

DETAILED DESCRIPTION OF THE INVENTION

Figure 1:
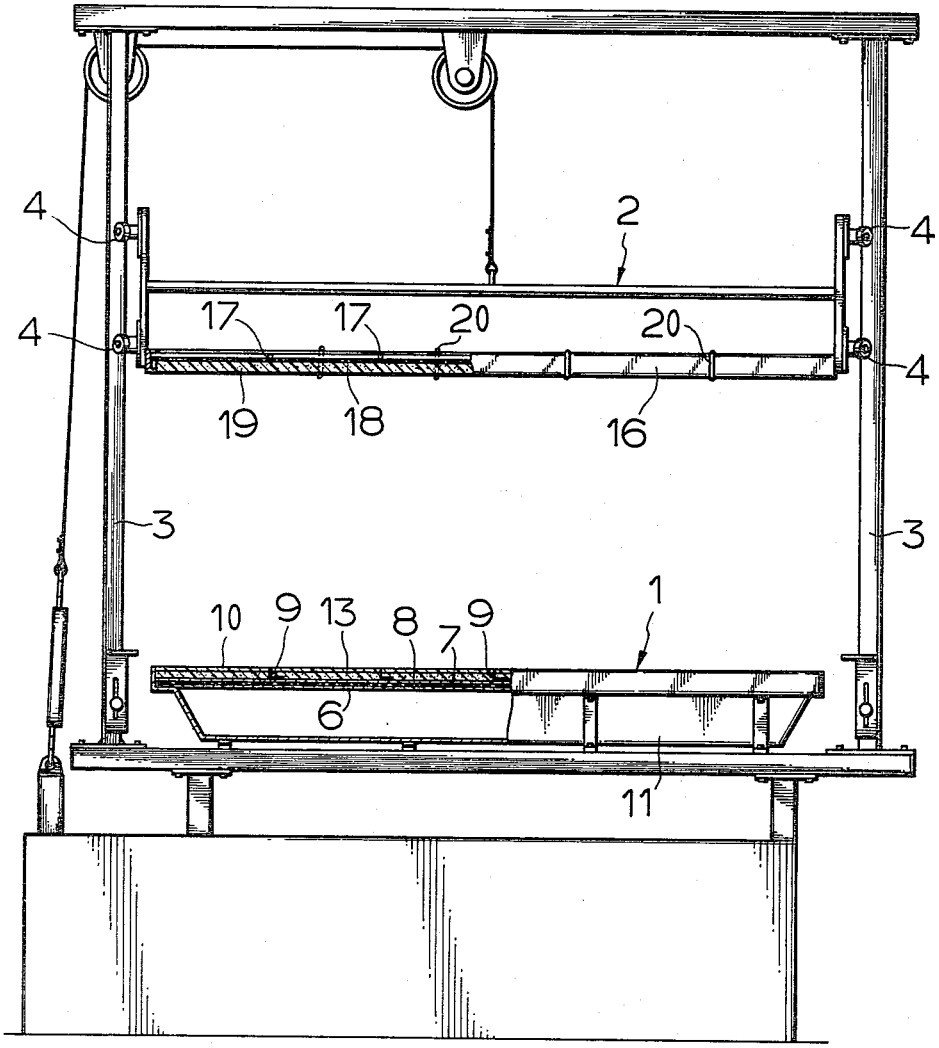
FIG. 1 is a schematic front view of a mark setting apparatus according to the present invention.
Figure 2:
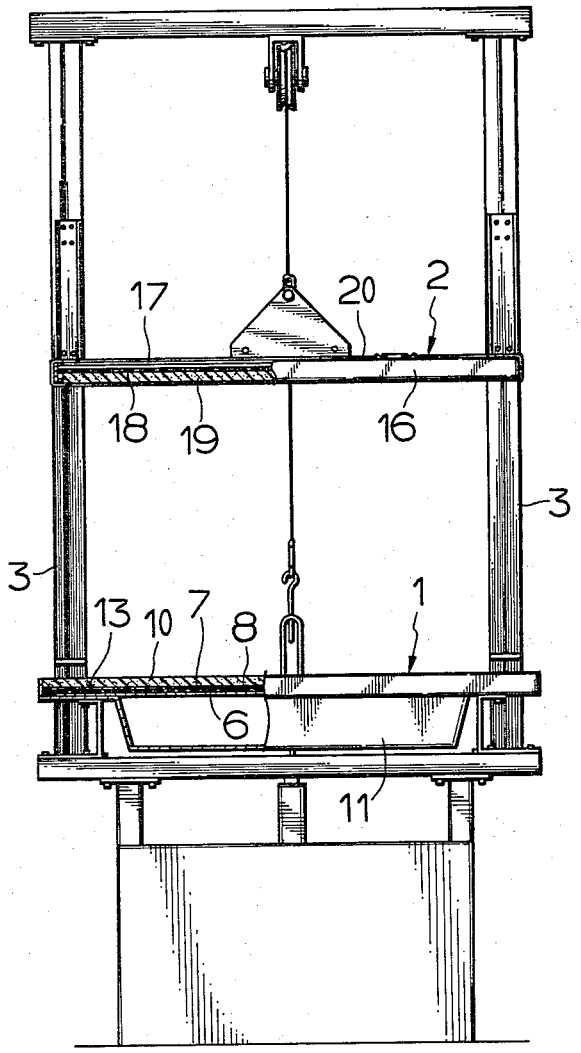
FIG. 2 is a schematic side view of the apparatus in FIG. 1.

Referring to FIGS. 1 and 2 the reference numeral 1 designates a working table horizontally supported about 1000 mm above the floor. Above this working table 1 there is provided a pressing frame 2 which is carried on four pillars 3 through rollers 4. Thus the pressing frame 2 is enabled to vertically move to and from the working table 1, during which a material (a) on the working table is pressed by the pressing frame 2.

Figure 3:
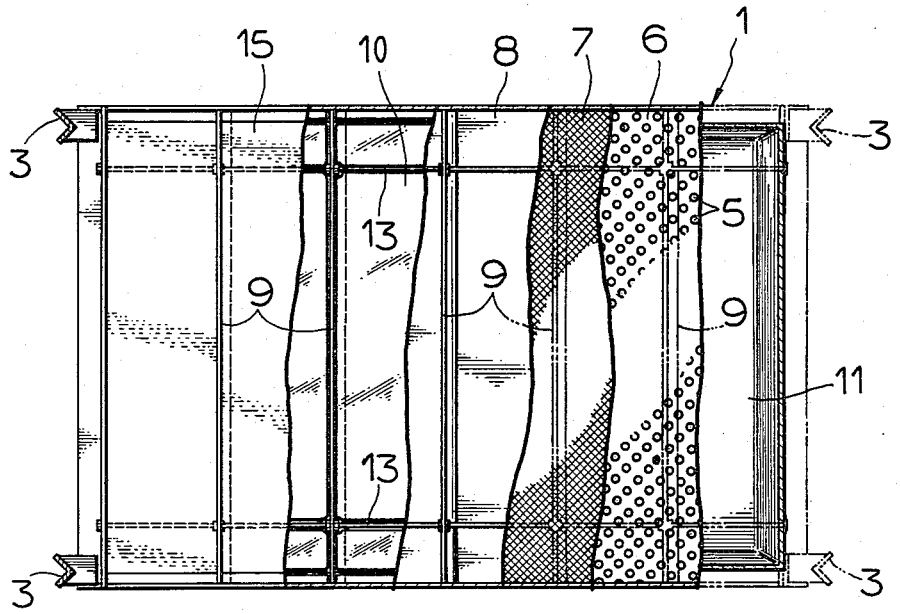
FIG. 3 is a plan view of a working table included in the apparatus.
Figure 4A:
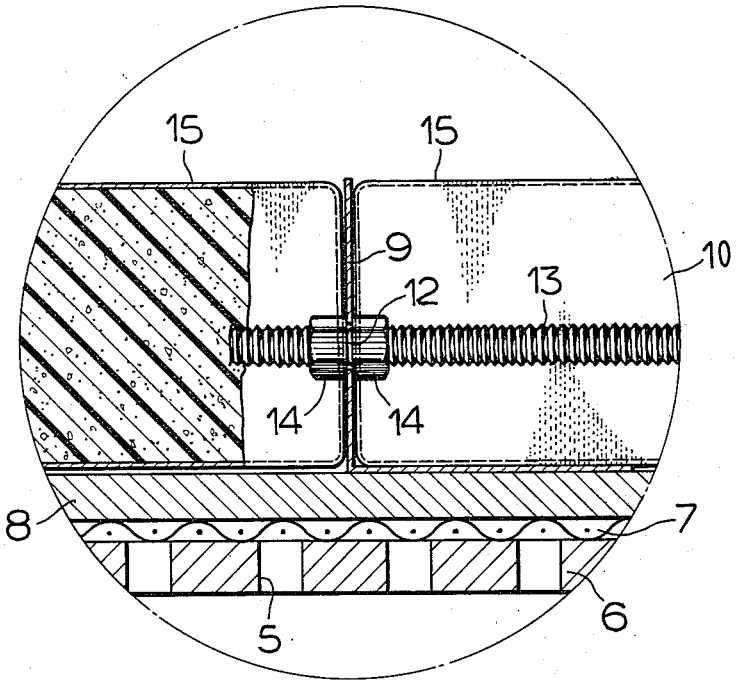
FIG. 4*a* is a cross-section on specially enlarged scale of the portion circled in FIG. 4.
Figure 4:
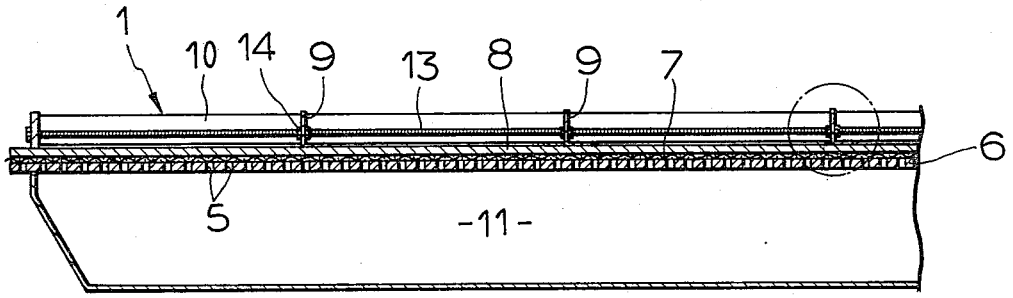
FIG. 4 is a vertical cross-section through the working table in FIG. 3.

As shown in FIGS. 3 and 4, the working table 1 is provided with a porous plate 6 in which a number of pores 5 are produced, a metal net 7 and a mat 8. On the mat 8 an appropriate number of metal bars 9 are crosswisely provided at equal intervals. The working table is covered with a cushioning 10 (hereinafter referred to as the lower cushioning when contrasted with another cushioning on the pressing frame), wherein the cushioning is divided into small parts so as to allow the metal bars 9 to be located therebetween. The working table 1 is provided with a steam reservoir 11 at its bottom. When a heat steam is introduced into the reservoir 11, the steam rises up through the porous plate 6, the metal net 7, the mat 8, and the lower cushioning 10, thereby producing a heated atmosphere on the working table 1.

For the metal bar 9 a thin aluminium bar is preferably employed because of its good thermal conductivity, workability and anti-rust property, but an iron bar can be effectively employed. The metal bar is L-shaped in its cross-section, and is provided with apertures 12 in its erected wall so as to allow a screw bar 13 to pass through as shown in FIG. 4. The screw bar 13 is made of stainless steel, and each metal bar 9 is locked to the screw bar 13 by means of nuts 14. The interval between the adjacent metal bars is determined with the design or type of an apparel to be made.

The cushioning 10 is preferably covered with a white cloth 15 on which, when required, patterns can be drawn as guides. In addition, it is preferred that each upper edge of the metal bars 9 is flush with the cushioning 10 or slightly protrudes.

Figure 5:
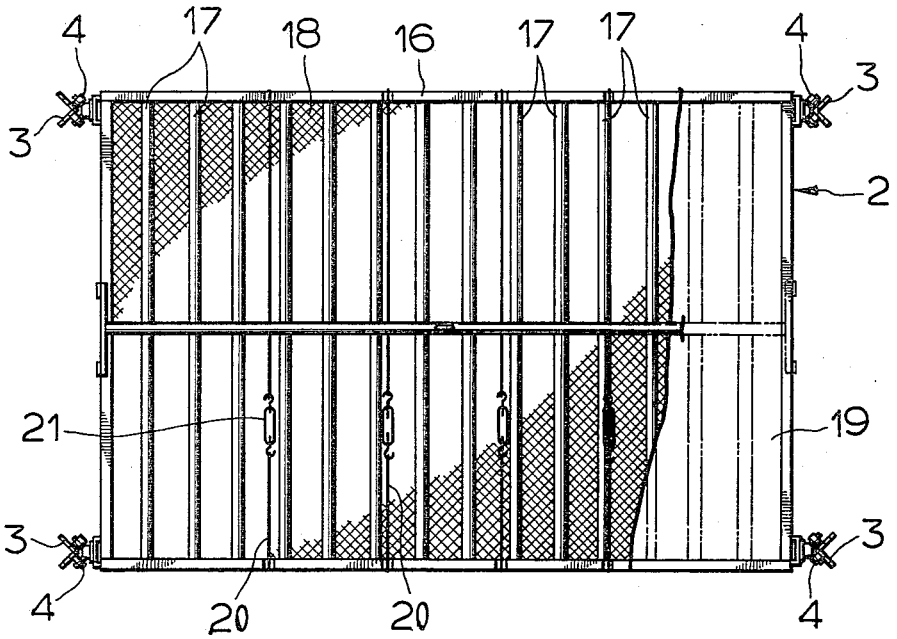
FIG. 5 is a plan view of a pressing frame included in the apparatus.
Figure 6:
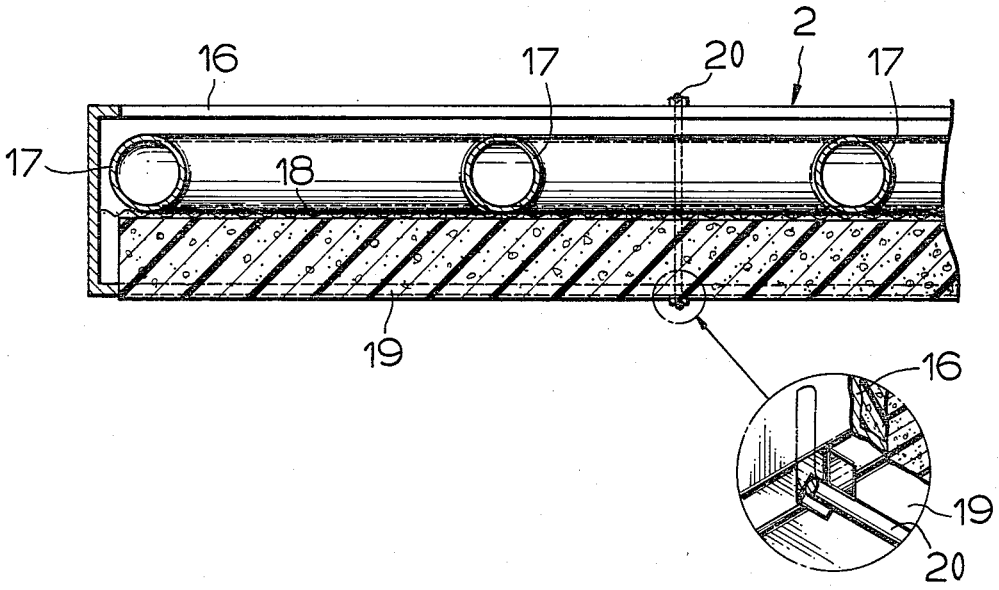
FIG. 6 is a vertical cross-section through the pressing frame in FIG. 5.

Referring to FIGS. 5 and 6 the pressing frame 2 includes an outer frame 16 in which several pipes 17 are transversely supported at intervals. Each pipe 17 is adapted to allow a heat steam to pass through, and as shown in FIG. 6, each pipe 17 rests on a metal net 18 under which an upper cushioning 19 is provided. The outer frame 16 are bound by several metal strings 20, wherein each string includes a tightener 21. It is preferred that each string 20 is flush with the undersurface of the upper cushioning 19, or slightly protrudes from it.

Figure 7:
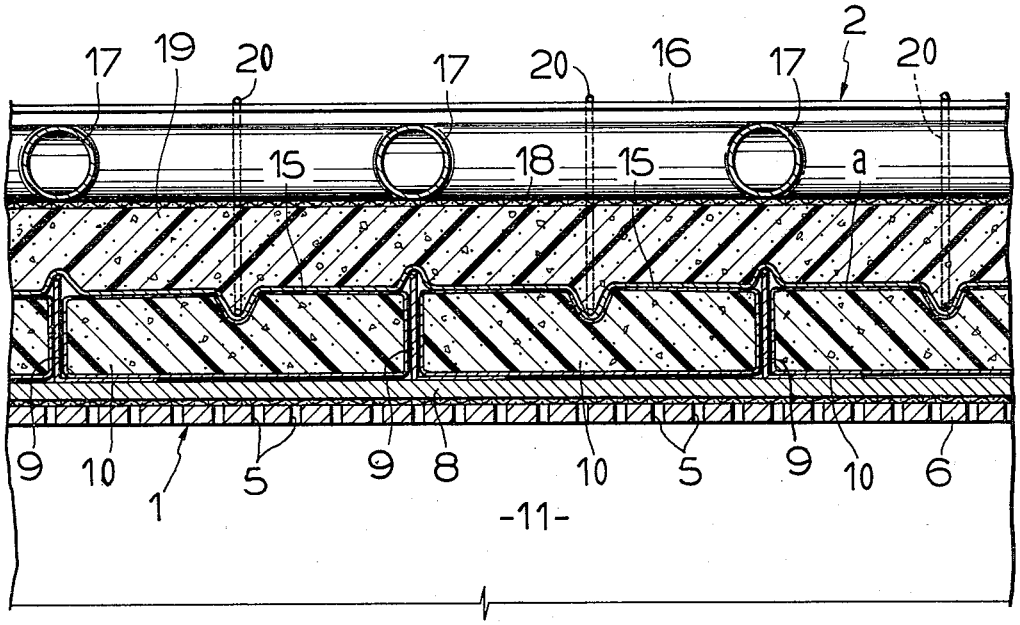
FIG. 7 is an explanatory view of the pressing frame and the working table when they are in operation.

In operation, a material (a) is placed on the working table 1 with the pressing frame 2 being kept above the working table. The pressing frame 2 is gradually lowered, and presses the material (a) against the working table 1 by gravity. As shown in FIG. 7, the material (a)

is compressed between the upper and lower cushionings 10 and 19, wherein the upper edges of the metal bars 9 and the protruded portions of the metal strings 20 are alternately placed into contact with the material (a). In this way the material (a) is provided with markings in the form of grooves.

At this stage a heat steam is introduced into the tank 11, which steam passes through the metal net 7, the mat 8, the lower cushioning 10, and reaches the material (a) placed between the working table and the pressing frame. The metal bars 9 and the metal strings 20 are heated by the steam, and the material (a) becomes moist. When the material (a) is made of knitted fabrics, the steam at about 135° C. can be effectively supplied for about 3 seconds.

Subsequently, a hot air at about 125° C. is introduced into the tank 11 for about 3 seconds, and a heat steam is also supplied into the pipes 17 so as to dry the material (a) as it is placed between the working table and the pressing frame. When it is found that the material (a) has dried up, the supply of the heat steam into the pipes 17 is stopped, and the hot air remaining between the working table and the pressing frame is sucked at a vacuum so as to allow the material (a) to cool down. Finally, the pressing frame 2 is raised, and the material (a) is made ready to be taken out.

Figure 8:
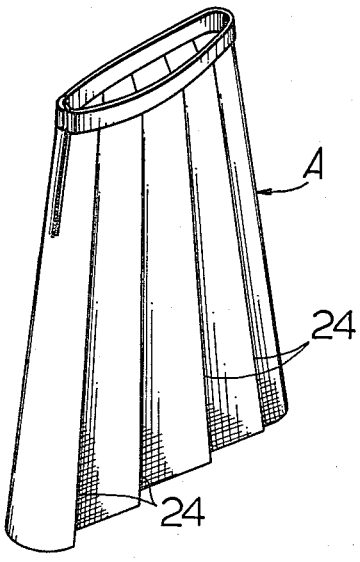
FIG. 8 is a perspective view of a skirt made of a material processed by the apparatus.

The material (a) is used to make a skirt (A), and the markings in the material (a) make skirt pleats 24 as shown in FIG. 8.

Figure 9:
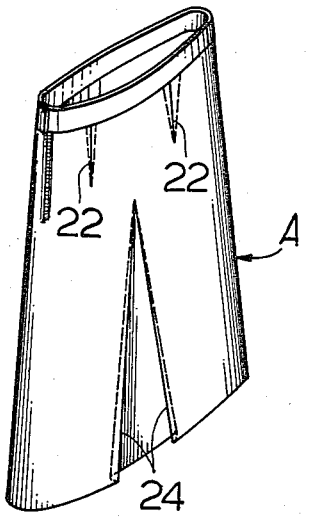
FIG. 9 is a perspective view of a different kind of skirt.
Figure 10:
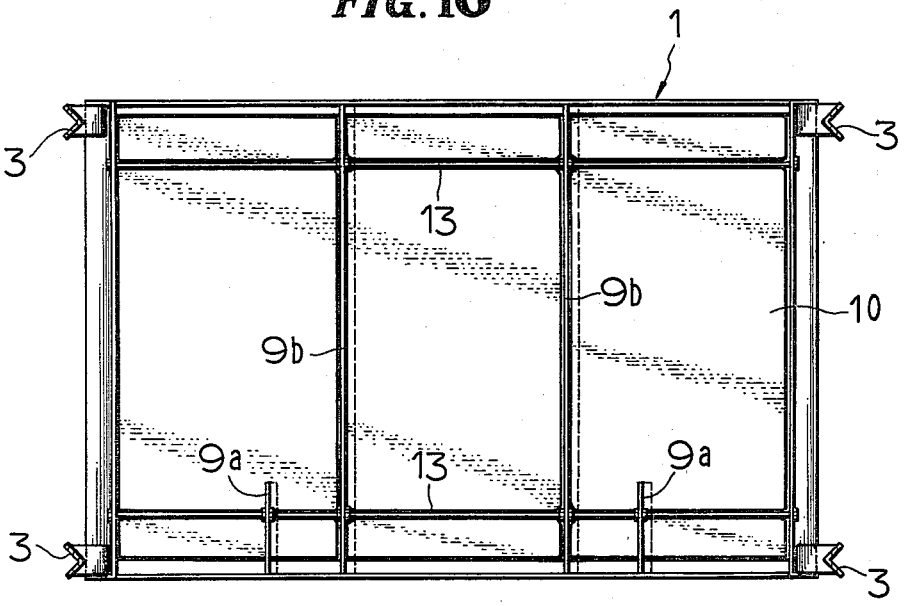
FIG. 10 is a plan view of a modified version of the pressing frame.

In the illustrated example it has been shown how to produce pleats in a skirt, but the present invention is not limited to the production of pleats. For example, as shown in FIG. 9 darts 22 can be made in addition to the pleats 24. In this case the working table 1 is provided with long metal bars **9*b* and short metal bars 9*a* wherein the long bars work to make the pleats 24 while the short bars work to make the darts 22**.

When folds are to be made in a skirt, marking blades 23 are provided on the undersurface of the pressing frame 2 as shown in FIG. 11, wherein the position of the marking blades are appropriately determined. The marking blades are likewise made of a thermal conductive material. The shapes and sizes of the metal bars and the marking blades are determined as desired.

What is claimed is:

1. A method for setting markings in a fabric by pressing the fabric between pressing surfaces having a pattern thereon, the improvement comprising:

adjusting hard ridges having good heat conductivity in accordance with a predetermined pattern, said hard ridges being disposed on at least one pressing surface and said pressing surface being covered with a cushion member;

pressing a fabric between the pressing surfaces whereby an edge of each of said hard ridges is pressed against the cushioning member of the opposing pressing surface through said fabric;

feeding heat steam to said fabric and hard ridges through said cushioning members;

thereafter feeding hot air to said fabric and hard ridges through said cushioning members; and removing said hot air under vacuum suction for cooling down said fabric and said hard ridges.

2. Apparatus for setting markings in a fabric comprising:

a working table having an upper surface covered with a cushioning member, said cushioning member allowing heat steam to pass therethrough;

pressing means, said pressing means having a lower surface covered with a cushioning member, said pressing means being vertically movable to and from said working table;

hard ridges having good heat conductivity on at least one of said upper surface and said lower surface;

feeding means for feeding heat steam and then hot air by turns to said working table and vacuum suction means for removing the hot air.

3. Apparatus for setting markings in a fabric comprising:

a working table including a reservoir; a porous plate above said reservoir; a metal net on said porous plate; a mat covering said porous plate; a plurality of metal bars disposed over said mat, each of said bars having apertures therein through which passes at least one screw bar, said metal bars being movable with respect to said screw bar, and means for locking said metal bars at a predetermined position on said screw bar; and lower cushioning means disposed between adjacent metal bars; and a pressing means, said pressing means being movable to and from said working table, said pressing means comprising an outer frame including a plurality of pipes supported at spaced intervals thereon, said pipes being operative to receive heat steam therein; said pipes being disposed on a metal net having an upper cushioning thereunder; and said outer frame having a plurality of metal strings thereon disposed across the underside of said cushioning and adapted for receiving heat from said pipes.

* * * * *